US007726643B2

(12) United States Patent
Werner

(10) Patent No.: US 7,726,643 B2
(45) Date of Patent: Jun. 1, 2010

(54) PAPER FEEDER HAVING HARD NIP AND FLEXIBLE NIP

(75) Inventor: Todd C. Werner, St. Petersburg, FL (US)

(73) Assignee: Pitney Bowes Inc., Stamford, CT (US)

( * ) Notice: Subject to any disclaimer, the term of this patent is extended or adjusted under 35 U.S.C. 154(b) by 492 days.

(21) Appl. No.: 11/647,701

(22) Filed: Dec. 28, 2006

(65) Prior Publication Data

US 2008/0157458 A1 Jul. 3, 2008

(51) Int. Cl.
*B65H 3/04* (2006.01)

(52) U.S. Cl. ..... 271/35; 271/165; 271/10.06; 271/4.05; 198/644

(58) Field of Classification Search ..... 271/165, 271/34, 35, 10.06, 4.05; 198/644, 817
See application file for complete search history.

(56) References Cited

U.S. PATENT DOCUMENTS 2,635,874 A 4/1953 La Bore
2004/0079683 A1* 4/2004 Utz et al. ..... 209/534
2006/0220299 A1* 10/2006 Kaiping ..... 271/35

* cited by examiner

*Primary Examiner*—Patrick Mackey
*Assistant Examiner*—Gerald W McClain
(74) *Attorney, Agent, or Firm*—Michael J. Cummings; Angelo N. Chaclas

(57) ABSTRACT

A friction feeder apparatus for handling sheets of paper of differing thicknesses includes a first plurality of laterally spaced apart transport belts positioned in underlying relation to the paper and a second plurality of laterally spaced apart separator wheels positioned in overlying relation to the paper. The transport belts are staggered with respect to the separator wheels. A sheet of paper passing through the feeder apparatus is undeflected from the top as it encounters the transport belts and is unsupported from the bottom as it encounters the separator wheels so that the sheet of paper is not held flat as it passes through the feeder but instead is forced into a wave-like, sinusoidal-like shape. In a first embodiment, the separator wheels are downstream of a fixed nip roller and in a second embodiment, the separator wheels are upstream of the fixed nip roller.

5 Claims, 6 Drawing Sheets

PAPER FEEDER HAVING HARD NIP AND FLEXIBLE NIP

FIELD OF THE INVENTION

This invention relates, generally, to sheet feeder machines that handle paper. More particularly, it relates to a paper feeder that forms one or more troughs into each sheet of paper passing through it and that can handle papers of varying thicknesses.

BACKGROUND OF THE INVENTION

Companies that mail large numbers of paper items require high-speed paper-handling machines such as paper feeders that can handle thin sheets of paper as well as relatively thick paper such as paperboard, cardboard, and the like. It is sometimes advantageous to handle the paper while the paper is maintained in a flat configuration.

In a typical prior art feeder, paper is supported from below and conveyed through the feeder by a plurality of rotatably-mounted laterally-spaced apart transport belts. A rotatably-mounted fixed nip roller is positioned between the transport belts, also supporting the paper from below, and a single rotatably-mounted separator wheel is positioned above the paper in confronting registration with the fixed nip roller. The structure forms a hard nip point where each sheet of paper passes over the fixed nip roller and under the separator wheel. Such structure restricts the feeder to handling sheets having a common thickness and said structure cannot impart a wave-like or other shape to the paper.

However, sometimes it is advantageous to impart a wave-like configuration to the paper. This is commonly accomplished by positioning a first and second pair of transport belts beneath the sheets of paper on opposite sides of the fixed nip roller and by positioning first and second separator wheels above the sheets at locations that are staggered relative to the first and second pairs of transport belts, respectively. In this way, the separator wheels and transport belts are not in alignment with one another nor is a separator wheel in alignment with the fixed nip roller. Thus, no hard nip point is formed. The result is a wave-like shape for the paper where crest and troughs are formed by the absence of support. Specifically, a crest appears where a transport belt supports the paper from below but no separator wheel is positioned above said transport belt and a trough appears where a separator wheel engages the paper from above but no transport belt supports the paper from below.

A major drawback of the known feeders that impart a wave into the paper being handled is that they are restricted to paper having only a single thickness. A user must therefore purchase a first sheet feeder machine for forming thin sheets of paper into a wave and a second sheet feeder machine for forming thick sheets of paper into a wave.

It is known in the art to use staggered transport belts to create crests and troughs in a sheet of paper or other sheet material. The waves formed are intermittent, i.e., discontinuous, but the distinction between intermittent and continuous transport belts, rollers, and the like is well-known in this art. One example of such a prior art arrangement is depicted in U.S. Pat. No. 2,635,874 to La Bore. A machine that incorporates this known technology is also disclosed at www.straightshooterequip.com. That machine eliminates the nip roller and places a separator means above and between transport belts so that the paper is continuously deflected from the top by the separator means, thereby forming a trough, and continuously deflected from the bottom by the transport belts, thereby forming crests. This is a continuous version of the intermittent deflections produced by the known apparatus. The known machine mentioned above must be operating if the belt positions are to be adjusted.

What is needed, then, is a friction feeder apparatus that can handle and impart a wave structure into both thin sheets and thick sheets, and sheets having intermediate thicknesses.

There is also a need for such a machine that includes a nip roller that can be disposed in confronting relation to a separator wheel or disposed in downstream or upstream relation thereto.

A need exists as well for a machine that for safety purposes can be adjusted only while it is not operating.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for an improved friction feeder is now met by a new, useful, and non-obvious invention. The novel friction feeder apparatus includes a first and second pair of transport belts and one or more separator wheels that can be adjustably positioned in the upstream and downstream direction parallel to the belts. Each transport belt of the first and second pair of transport belts is staggered with respect to its associated separator wheel. A fixed nip roller is positioned between the first and second pair of transport belts.

In a first embodiment, one or more separator wheels are adjustably positioned downstream relative to the fixed nip roller.

In a second embodiment, one or more separator wheels are adjustably positioned upstream relative to the fixed nip roller.

In both of said embodiments, the novel feeder can handle sheets of paper of varying thicknesses.

An item of paper or other sheet material having a flexible structure passing over the transport belts is unsupported from the bottom as it encounters the one or more separator wheels and is unsupported from the top as it is carried by the transport belts. Accordingly, the item of paper is forced into a wave-like, sinusoidal-like shape including crests and troughs as it passes through the feeder.

Thus, an important advantage is that a user need purchase only one sheet feeder even if the user has requirements for both thin and thick sheets of paper.

The sheet feeder includes a belt carriage and frame assembly upon which is mounted the transport belts, the separator wheels, and the fixed nip roller. Advantageously, the belt carriage and frame assembly is removably mounted to the frame so that a new belt carriage and frame assembly may be installed quickly, with minimal downtime, as needed. More particularly, the frame of the friction feeder includes a pair of parallel, laterally spaced apart channels that slidingly engage opposite ends of the belt carriage and frame assembly. A first clip, pivotally mounted to a first channel, releasably engages a first side of the belt carriage and frame assembly and a second clip, pivotally mounted to a second channel, releasably engages a second side of the belt carriage and frame assembly. The leading end of each clip is angled away from the leading end of its channel so that the clip is momentarily pivoted upwardly when the belt carriage and frame assembly is slid into the channels. Each clip then falls under the force of gravity into engagement with the belt carriage and frame assembly. It is therefore easy to pivot each clip out of engagement with its end of the belt carriage and frame assembly and slide an old belt carriage and frame assembly out of the channels and to slide a new one into the channels.

Instead of replacing an old belt carriage and frame assembly with a new one, an old belt carriage and frame assembly may be refurbished by replacing worn belts with new belts and sliding the refurbished belt carriage and frame assembly back into the friction feeder.

Moreover, different types of belt carriage and frame assemblies may be inserted into the friction feeder. For example, an accelerator carriage and frame assembly having two sets of belts that rotate at different speeds may be slideably inserted into the feeder upon removal of the standard belt carriage and frame assembly.

These and other advantages will become apparent as this disclosure proceeds. The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which:

FIGS. 2A'-2D' depict an alternate embodiment of FIGS. 2A-2D where there is only one separator wheel instead of two;

FIGS. 3A'-3D' depict an alternate embodiment of FIGS. 3A-3D where there is only one separator wheel instead of two;

DETAILED DESCRIPTION OF THE PREFERRED EMBODIMENT

Figure 1A:
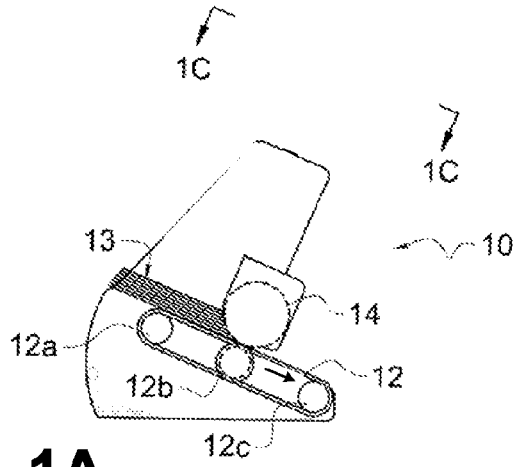
FIG. 1A ( PRIOR ART )
FIG. 1A is a side elevational diagrammatic view of a prior art sheet feeder having a separator wheel centered on a fixed position hard nip roller.
Figure 1B:
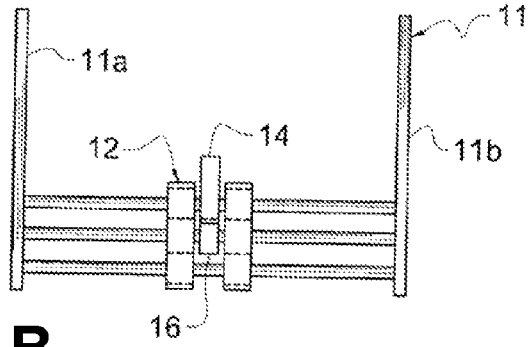
FIG. 1B ( PRIOR ART )
FIG. 1B is a front elevational diagrammatic view of the prior art feeder of FIG. 1A.
Figure 1C:
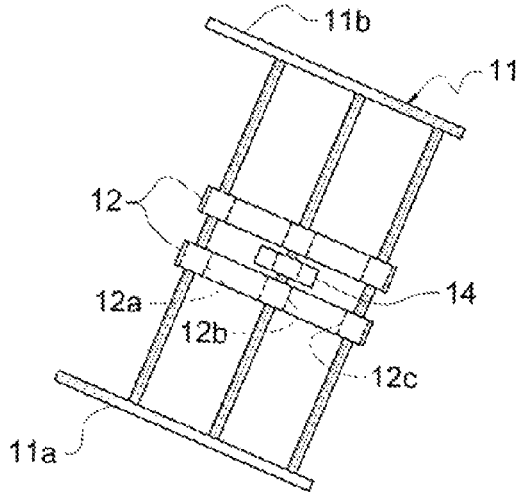
FIG. 1C ( PRIOR ART )
FIG. 1C is a view taken along line 1C-1C in FIG. 1A.

Referring now to FIGS. 1A, 1B, and 1C it will there be seen that a prior art sheet feeder apparatus in the field of this invention is denoted as a whole by the reference numeral 10.

A pair of laterally spaced apart transport belts is denoted as a whole by the reference numeral 12 with arrow, a separator wheel is denoted 14, and a fixed nip roller is denoted 16. All of said parts are mounted on a belt carriage and frame assembly denoted 11 as a whole. Fixed nip roller 16 is positioned in confronting registration with separator wheel 14, said parts forming a hard nip point.

More particularly, belt carriage and frame assembly 11 includes a pair of frame arms 11*a*, 11*b* that are disposed in laterally spaced apart, parallel relation to one another. Assembly 11 forms an integral part of sheet feeder apparatus 10.

Transport belts 12 support from below and convey a sheet of paper passing through feeder 10. Fixed nip roller 16 also supports each sheet from below. Separator wheel 14 engages each sheet from above. The confronting relationship of separator wheel 14 and fixed nip roller 16, together with the supporting function provided by transport belts 12, ensures that each sheet of paper passing through feeder 10 is maintained in a flat configuration.

A stack of paper or other flat goods is denoted in FIG. 1A by the reference numeral 13. As is the case with all prior art paper feeders 10, each sheet of paper or other product in stack 13 must have the same thickness as all of the other sheets in said stack; variable thickness product cannot be fed by prior art feeder 10.

A first embodiment of the novel sheet feeder apparatus is depicted in FIGS. 2A-D. The belt carriage and frame assembly of this embodiment is denoted 21 as a whole because it differs in important structural details from prior art belt carriage and frame assembly 11.

A first pair of transport belts is denoted 18, a second pair of transport belts is denoted 20, and said second pair is disposed in laterally spaced relation to the first pair. The number of transport belts is not limited to the number depicted in this figure. Moreover, the transport belt assemblies are laterally adjustable along the extent of the rods upon which they are mounted.

A first separator wheel 22 is mounted between the transport belts of the first pair of transport belts 18 and a second separator wheel 24 is mounted between the transport belts of the second pair of transport belts 20. Fixed nip roller 16 is mounted between the first and second pairs of transport belts and no separator wheel is in confronting registration therewith.

Figure 2A:
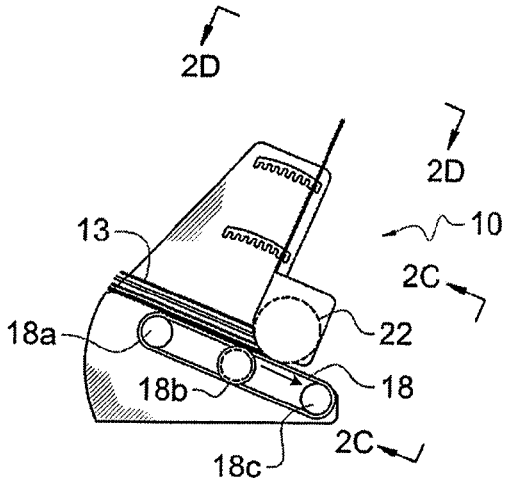
FIG. 2A is a side elevational diagrammatic view of the novel apparatus when a first separator wheel is positioned downstream of and between a first pair of transport belts and a second separator wheel is positioned downstream of and between a second pair of transport belts.
Figure 2B:
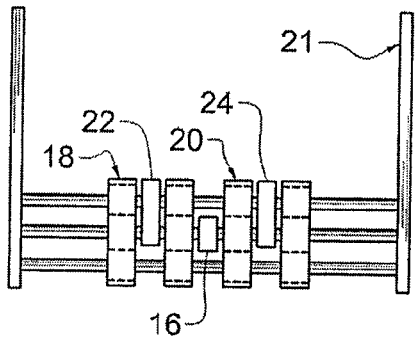
FIG. 2B is a front elevational diagrammatic view of the feeder depicted in FIG. 2A.

Configurations including only one separator wheel are also within the scope of this invention. An exemplary embodiment with one separator wheel 22 is depicted in FIGS. 2A'-2D', where the separator wheel 22, is positioned in line with nip roller 16, and just downstream of the nip roller 16. The one or more separator wheels 22, 24 can be positioned anywhere along the width of the assembly, and selection of the appropriate arrangement is made possible by the novel adjustment features described herein.

Figure 2C:
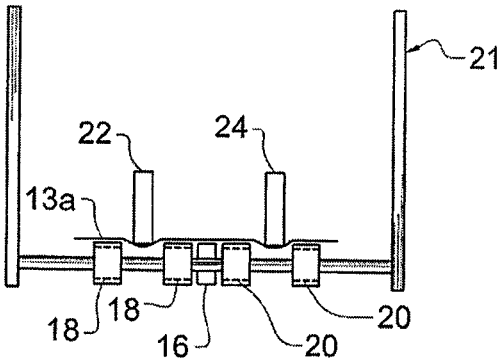
FIG. 2C is an end view of a sheet of paper passing through the feeder of FIGS. 2A and 2B, taken along line 2C-2C in FIG. 2A.
Figure 2D:
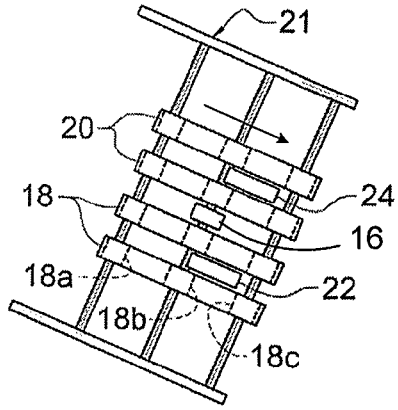
FIG. 2D is a view taken along line 2D-2D in FIG. 2A.
Figure 2A:
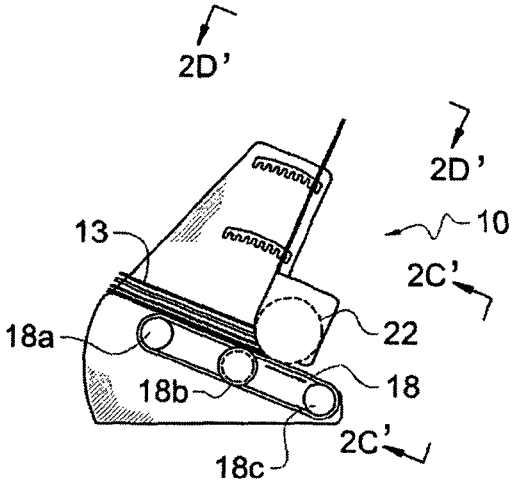
Figure 2B:
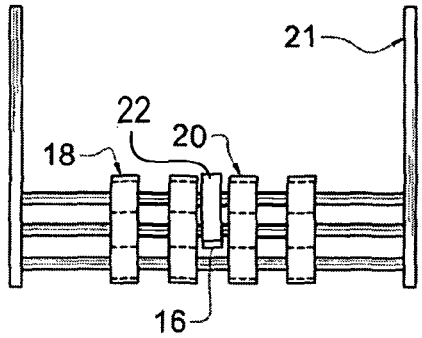
Figure 2C:
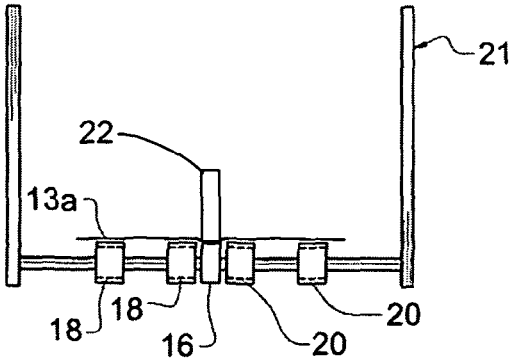
Figure 2D:
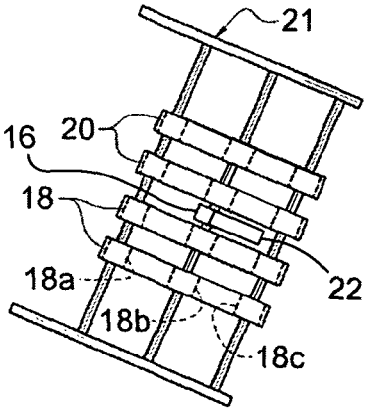

A sheet of paper passing through feeder 10 is undeflected from above as it encounters transport belts 18, 20 and is unsupported from below as it encounters separator wheels 22, 24. Note from FIGS. 2A and 2D that separator wheels 22 and 24 are mounted downstream of fixed nip roller 16 in this first embodiment. A sheet of paper 13*a* passing through feeder 10 when it is in its downstream configuration is forced into a wave-like or sinusoidal-like shape as depicted in FIG. 2C.

The positioning of separator wheels 22 and 24 downstream of fixed nip roller is accomplished by building friction feeder 10 in two (2) parts, i.e., an upper and lower part. The separator wheel or wheels are mounted on the upper part so that the upper part may be moved downstream or upstream of the fixed nip roller. Notches, collectively denoted, 15, selectively receive the upper frame in each of its positions. As drawn, when an upper edge of the upper frame is positioned within the left-most notch, the separator wheel or wheels are positioned a maximum distance downstream from the hard nip roller. When an upper edge of the upper frame is positioned within the right-most notch, the separator wheel or wheels are positioned a maximum distance upstream from the hard nip roller.

However, it is the relative positioning of the separator wheel or wheels with respect to the hard nip roller that is critical. It is not critical as to whether the separator wheel or wheels are moved or whether said separator wheel or wheels remain stationary while the hard nip roller is moved. If the separator wheel or wheels were stationary, then notches 15 would be eliminated because the upper frame of the feeder would not be movable. Similar notches would then be provided in the lower part of the frame to enabler movement of the hard nip roller.

Unlike the prior art feeder of FIGS. 1A-C, novel feeder 10 handles paper 13 of variable thickness.

Figure 3A:
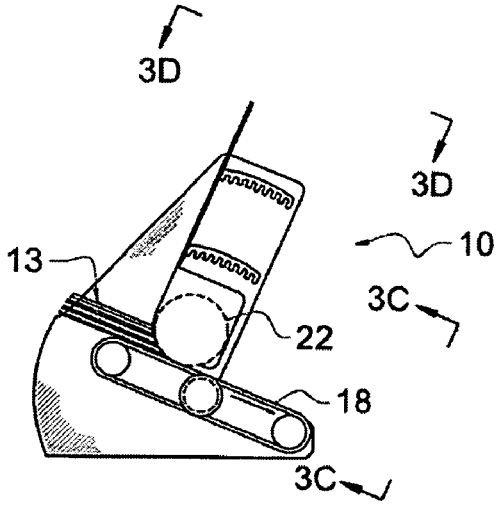
FIG. 3A is a side elevational diagrammatic view of the novel apparatus when a first separator wheel is positioned upstream of and between a first pair of transport belts and a second separator wheel is positioned upstream of and between a second pair of transport belts.
Figure 3B:
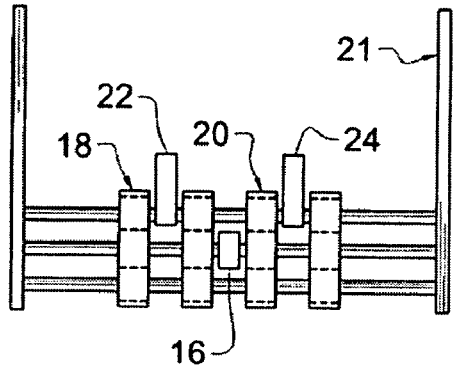
FIG. 3B is front elevational diagrammatic view of the feeder depicted in FIG. 3A.
Figure 3C:
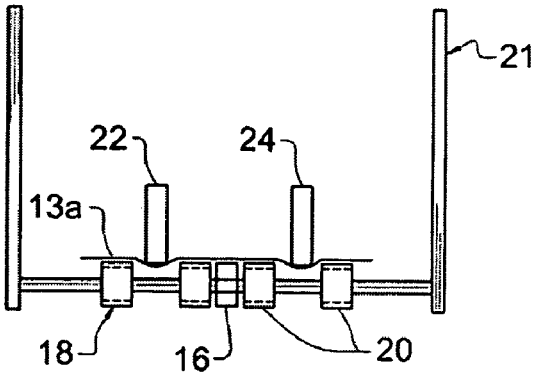
FIG. 3C is an end view of a sheet of paper passing through the feeder of FIGS. 3A and 3B, taken along line 3C-3C in FIG. 3A.
Figure 3D:
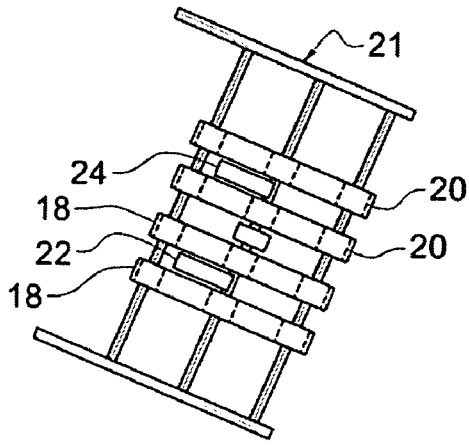
FIG. 3D is a view taken along line 3D-3D in FIG. 3A.
Figure 3A:
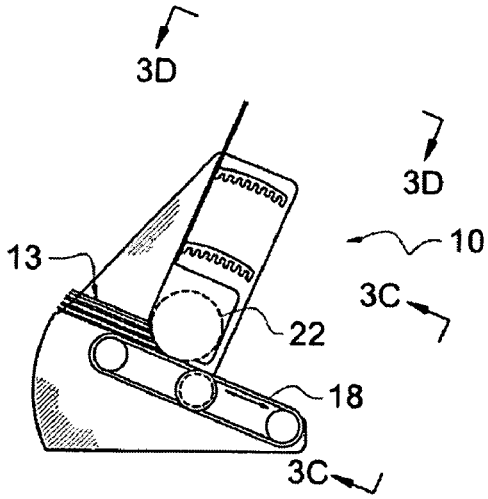
Figure 3B:
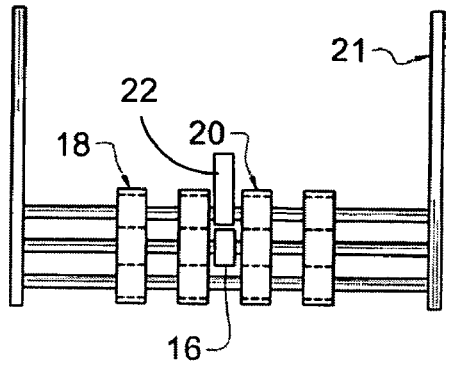
Figure 3C:
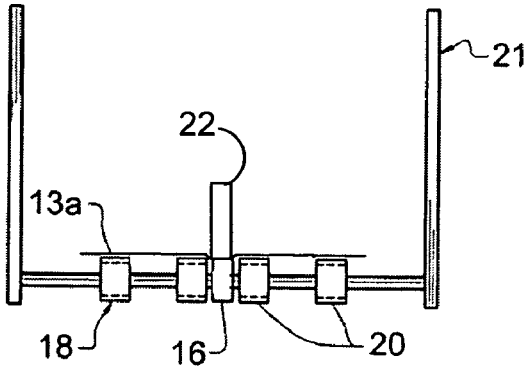
Figure 3D:
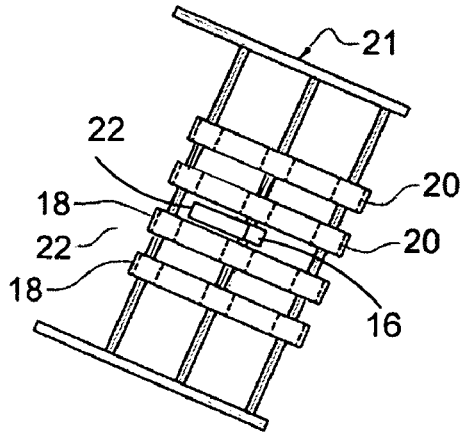

The second embodiment of the invention is depicted in FIGS. 3A-D. Note that the structure is the same as the first embodiment but with separator wheels 22, 24 being positioned upstream of fixed nip roller 16 as best understood in connection with FIGS. 3A and 3D. Paper 13*a* passing through feeder 10 when in its upstream configuration is forced into a wave-like or sinusoidal-like shape as depicted in FIG. 3C.

Significantly, both the first and second embodiments can handle papers of varying thicknesses, unlike the prior art feeder of FIGS. 1-C.

The leading edge of an item of sheet material will first encounter the hard nip roller when the separator wheel or wheels are downstream of the hard nip roller and will first encounter the separator wheel or wheels when said separator wheel or wheels are upstream of the hard nip roller. In the former configuration of parts, the leading edge of the item of sheet material will first abut a circular wall or face of the separator wheel at a point above the bottom of the wheel before being propelled under the wheel. In the latter configuration of parts, the leading edge of the item of sheet material will substantially align with the bottom edge of the separator wheel before being propelled under the wheel.

Transforming novel feeder 10 from its downstream configuration to its upstream configuration, and vice versa, is accomplished in just a few seconds.

As discussed in connection with FIGS. 2A-2D and 2A'-2*d*', configurations including only one separator wheel are also within the scope of this invention. An exemplary embodiment with one separator wheel 22 positioned upstream of the nip roller 16 is depicted in FIGS. 3A'-3D'. The selection of the upstream, as seen in FIG. 3, or downstream, as seen in FIG. 2, for the one or more separator wheels 22, 24 can be made based on the operator's observation and experience with the unique properties of different styles of sheets that are being fed. The one or more separator wheels 22, 24 can be positioned anywhere along the width of the assembly, and selection of the appropriate arrangement is made possible by the novel adjustment features described herein.

Figure 4A:
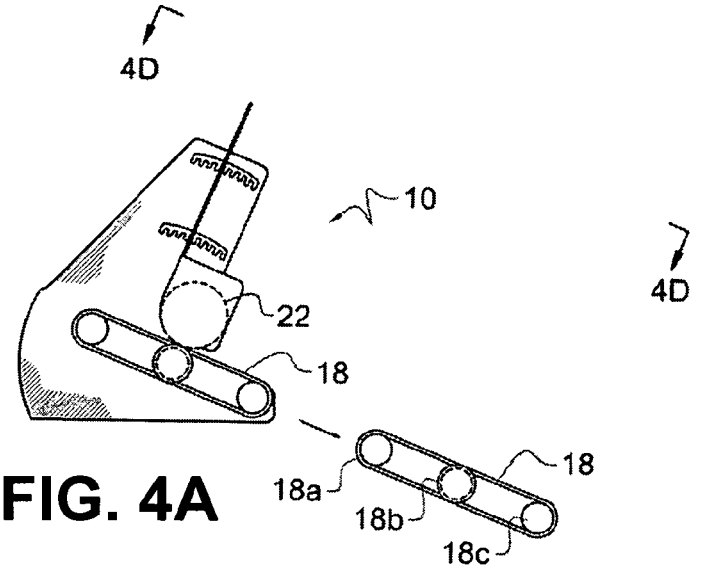
FIG. 4A is a side elevational diagrammatic view of the novel sheet feeder, indicating how the transport belt carriage is quickly removable from its frame.
Figure 4B:
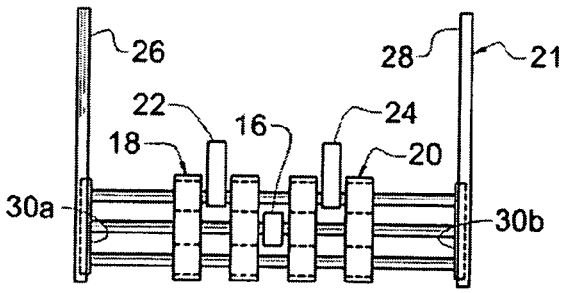
FIG. 4B is a front elevational diagrammatic view depicting the transport belt carriage when connected to its frame.
Figure 4C:
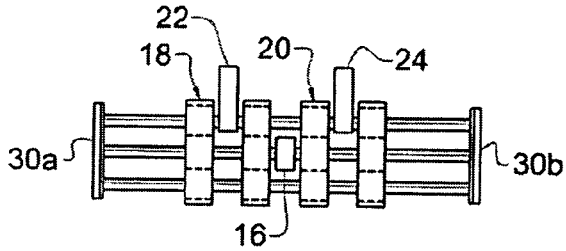
FIG. 4C is a front elevational diagrammatic view depicting the transport belt carriage when slideably removed from its frame.
Figure 4D:
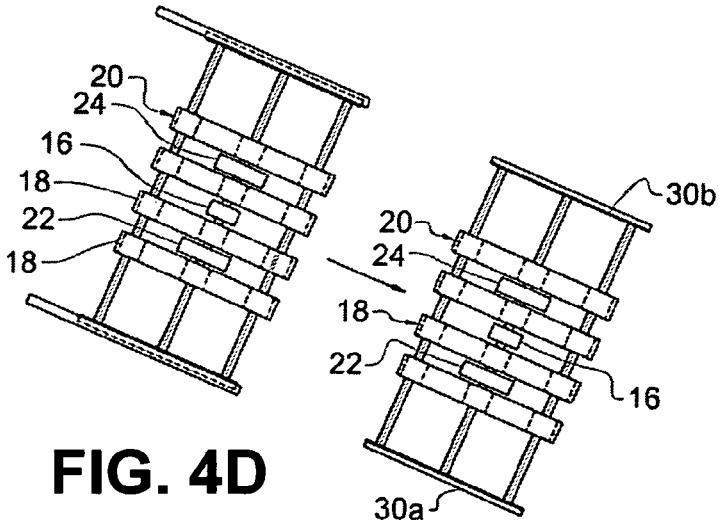
FIG. 4D is a view taken along line 4D-4D in FIG. 4A.

FIG. 4A depicts how belt carriage 21 is slideably removed from its frame. FIG. 4B provides a front elevational view of belt carriage 21 when attached to said frame and FIG. 4C is a front elevational view depicting belt carriage 21 when slideably removed from said frame. FIG. 4D is a top view of the parts depicted in FIG. 4A. This slideable removability facilitates fast slideable insertion of a new, refurbished, or different type of belt carriage when an old belt carriage requires replacement.

More particularly, belt carriage and frame assembly 21 includes a frame having a first arm 26 and a second arm 28 disposed in parallel, laterally spaced apart relation to one another. Belt carriage 30 has a first end 30*a* slideably engaged to first arm 26 and a second end 30*b* slideably engaged to second arm 28.

Removing a worn belt carriage is accomplished quickly by sliding first and second ends 30*a*, 30*b* of a worn belt carriage 30 out of engagement with first and second channels 26, 28, respectively, and sliding opposite ends of a new, refurbished, or even different type of belt carriage and frame assembly into sliding engagement with said frame channels 26, 28.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A friction feeder apparatus for handling paper of differing thicknesses, comprising:

a first pair of laterally spaced apart transport belts positioned in underlying relation to said paper;

a second pair of laterally spaced apart transport belts positioned in underlying relation to said paper;

said first and second pair of transport belts being laterally spaced apart from one another;

a first separator wheel adjustably positioned between the transport belts of said first pair of transport belts, said first separator wheel being adjustably positionable in the upstream and downstream directions relative to the transport belts;

a second separator wheel adjustably positioned between the transport belts of said second pair of transport belts, said second separator wheel being adjustably positionable in the upstream and downstream directions relative to the transport belts;

whereby a sheet of paper passing through said sheet feeder apparatus is unsupported from the top as the sheet encounters the first and second pair of transport belts and is unsupported from the bottom as it encounters said first and second separator wheels so that said sheet of paper is forced into a substantially wave-shaped configuration.

2. The friction feeder apparatus of claim 1, further comprising:

a hard nip roller positioned between said first pair of transport belts and said second pair of transport belts;

said first and second separator wheels being positioned downstream with respect to said hard nip roller.

3. The friction feeder apparatus of claim 1, further comprising:

a hard nip roller positioned between said first pair of transport belts and said second pair of transport belts;

said first and second separator wheels being positioned upstream with respect to said hard nip roller.

4. The friction feeder apparatus of claim 1, further comprising:

said first pair of transport belts, said second pair of transport belts, said first separator wheel and said second separator wheel being mounted on a belt carriage;

a frame having a first arm and a second arm disposed in parallel, laterally spaced apart relation to one another;

said belt carriage being slideably and removably mounted between said first and second arms;

whereby replacing a worn belt carriage is accomplished quickly by sliding said worn belt carriage out of said frame and sliding a new belt carriage into said frame.

5. The friction feeder apparatus of claim 1, further comprising:

a hard nip roller positioned between said first pair of transport belts and said second pair of transport belts;

said first and second separator wheels being adjustably positionable upstream and downstream of said hard nip roller.

* * * * *